US009394712B2

(12) United States Patent
Becci et al.

(10) Patent No.: US 9,394,712 B2
(45) Date of Patent: Jul. 19, 2016

(54) ASEISMIC CONNECTION DEVICE FOR CONNECTING A PANEL TO A BEAM

(71) Applicant: Innocenzo Becci, Tolentino (IT)

(72) Inventors: Innocenzo Becci, Tolentino (IT); Francesco Foresi, Morrovalle (IT)

(73) Assignee: Innocenzo BECCI, Tolentino (IT)

( * ) Notice: Subject to any disclaimer, the term of this patent is extended or adjusted under 35 U.S.C. 154(b) by 0 days.

(21) Appl. No.: 14/779,482

(22) PCT Filed: Apr. 5, 2014

(86) PCT No.: PCT/EP2014/056886
§ 371 (c)(1),
(2) Date: Sep. 23, 2015

(87) PCT Pub. No.: WO2014/166849
PCT Pub. Date: Oct. 16, 2014

(65) Prior Publication Data

US 2016/0040446 A1 Feb. 11, 2016

(30) Foreign Application Priority Data

Apr. 12, 2013 (IT) ..... RE2013A0026

(51) Int. Cl.

| | |
|---|---|
| ***E04H 9/02*** | (2006.01) |
| ***E04B 1/38*** | (2006.01) |
| ***E04B 1/92*** | (2006.01) |
| *E04B 2/94* | (2006.01) |

(52) U.S. Cl.
CPC *E04H 9/021* (2013.01); *E04B 1/38* (2013.01); *E04B 1/92* (2013.01); *E04B 2/94* (2013.01)

(58) Field of Classification Search
CPC ..... E04B 1/38; E04B 1/92; E04H 9/021
USPC ..... 52/167.1, 167.3
See application file for complete search history.

(56) References Cited

U.S. PATENT DOCUMENTS

| | | | | |
|---|---|---|---|---|
| 4,065,218 | A * | 12/1977 | Biggane | 403/71 |
| 4,179,104 | A * | 12/1979 | Skinner et al. | 267/154 |
| 5,035,099 | A * | 7/1991 | Lapish | 52/713 |
| 5,664,389 | A * | 9/1997 | Williams | 52/677 |
| 6,230,450 | B1 * | 5/2001 | Kuroda et al. | 52/167.8 |
| 6,634,615 | B1 * | 10/2003 | Bick et al. | 248/499 |
| 6,763,634 | B1 * | 7/2004 | Thompson | 52/92.2 |
| 6,896,226 | B2 * | 5/2005 | Heath | 248/62 |
| 8,534,625 | B2 * | 9/2013 | Heath et al. | 248/226.11 |
| 8,726,607 | B1 * | 5/2014 | Kirschner | 52/713 |
| 9,200,444 | B2 * | 12/2015 | Ra | |
| 2010/0299891 | A1 * | 12/2010 | Myers | 24/457 |
| 2015/0233113 | A1 * | 8/2015 | Ueno | E04B 1/98 |
| 2015/0252916 | A1 * | 9/2015 | Heath et al. | F16L 3/133 |

* cited by examiner

*Primary Examiner* — James Buckle, Jr.
(74) *Attorney, Agent, or Firm* — Egbert Law Offices, PLLC

(57) ABSTRACT

A seismic connection device for connecting a panel to a beam includes a dissipating element with a longitudinal axis fixed to the beam only in correspondence of its longitudinal ends, a sliding connector slidingly mounted on the dissipating element in such manner to slide along the longitudinal axis of the dissipating element, a fixed connector fixed to the panel, a tensioning element disposed between the fixed connector and the sliding connector to allow for a linear displacement of the fixed connector towards the sliding connector. The panel is adapted to move with respect to the beam in the direction of the longitudinal axis.

9 Claims, 3 Drawing Sheets

ASEISMIC CONNECTION DEVICE FOR CONNECTING A PANEL TO A BEAM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to an aseismic connection device used to connect a panel to a beam.

2. Description of Related Art Including Information Disclosed Under 37 CFR 1.97 and 37 CFR 1.98

FIG. 1 is a diagrammatic view of a portion of a building structure that comprises pillars (M) fixed to the ground, a beam (T) disposed above the pillars (M) and panels (P) fixed to the ground and to the beam (T). The pillars (M) and the beam (T) form a supporting structure and the panels (P) form lateral walls supported by the supporting structure.

Various systems are known to fix the panels (P) to the beam (T). However, the known types of fixing systems generally do not guarantee an aseismic performance.

In fact, being fixed to the ground, the pillars (M) tend to oscillate during an earthquake. The most dangerous oscillations are the oscillations of the pillars (M) in the direction of the arrows (F) illustrated in the figure, which are basically parallel to the longitudinal axis (X) of the beam (T). In such a case, the beam (T) tends to alternately move in the direction of its longitudinal axis (X). Consequently, being fixed to the ground and to the beam (T), the panels (P) are subject to a high shear force and tend to crack, if not break.

JP2004-036337 discloses a bridge falling preventing device. The function of such a device is not to connect two elements. In fact, the device is disposed between two elements that are already connected, i.e. the bridge and a bridge support. Therefore, the device does not provide for any tensioning element to bring the two elements closer. Such a device is known as seismic stop. In fact, the function of the device is to block the bridge in position, in case of earthquake or structural failure, and therefore it prevents the relative sliding of the bridge with respect to the supporting pillar in orthogonal direction to the axis of the device.

JP2002-097607 discloses a shock absorbing chain disposed between two beams of a highway road in order to prevent the beam from falling in case of earthquake or structural failure. Also in this case, the chain acts as seismic stop, like the device of JP2004-036337.

WO2004/007991 discloses a fallout prevention device used to avoid the fall of the structures of a bridge, in the form of a seismic stop that reduces the relative motion between two structures in case of earthquake and consequently avoids an excessive deformation of the bridge.

The devices disclosed in JP2004-036337, JP2002-097607 and WO2004/007991 are seismic stops, are applied between two structures that are already installed firmly, and are used to reduce the relative displacement between the two structures to a preset maximum displacement value in the direction of the device axis. The aforementioned devices are not used to fix the two structures together and do not guide the relative displacement of the two structures in orthogonal direction to the axis of the device.

The purpose of the present invention is to eliminate the drawbacks of the prior art by devising a connection device used to connect a panel to a beam, which is able to prevent the panels from breaking in case of earthquake.

Another purpose of the present invention it so disclose a connection device that is able to connect a panel to a beam in an efficient, reliable, safe, simple and rapid way.

BRIEF SUMMARY OF THE INVENTION

These purposes are achieved according to the invention, with the characteristics claimed in the independent claim 1.

Advantageous embodiments of the invention appear from the dependent claims.

The aseismic connection device used to connect a panel to a beam according to the invention comprises:

- a dissipating element shaped as a bar with longitudinal axis fixed to the beam in such manner that the longitudinal axis of the dissipating element is parallel to the longitudinal axis of the beam,
- a sliding connector slidingly mounted on the dissipating element in such manner to slide along the longitudinal axis of the dissipating element,
- a fixed connector fixed to the panel in correspondence of a transverse axis orthogonal to the longitudinal axis and passing through a mid point of the dissipating element,
- a tensioning element disposed between the fixed connector and the sliding connector in such manner to allow for a linear displacement of the fixed connector towards the sliding connector in the direction of the transverse axis until the panel stops against a longitudinal edge of the beam in such a way to connect the panel to the beam, wherein said panel is not able to move with respect to the beam in the direction of the transverse axis and said panel is able to move with respect to the beam in the direction of the longitudinal axis.

The advantages of the connection device according to the present invention are evident, it being able to fix a panel firmly to a beam and at the same time allow the beam to slide with respect to the panel in the direction of the longitudinal direction of the beam, thus avoiding a high shear force on the panel when the beam oscillates because of an earthquake.

BRIEF DESCRIPTION OF THE DRAWINGS

Further characteristics of the invention will appear clearer from the detailed description below, which refers to merely illustrative, not limitative embodiments, illustrated in the attached drawings, wherein.

DETAILED DESCRIPTION OF THE INVENTION

Figure 1:
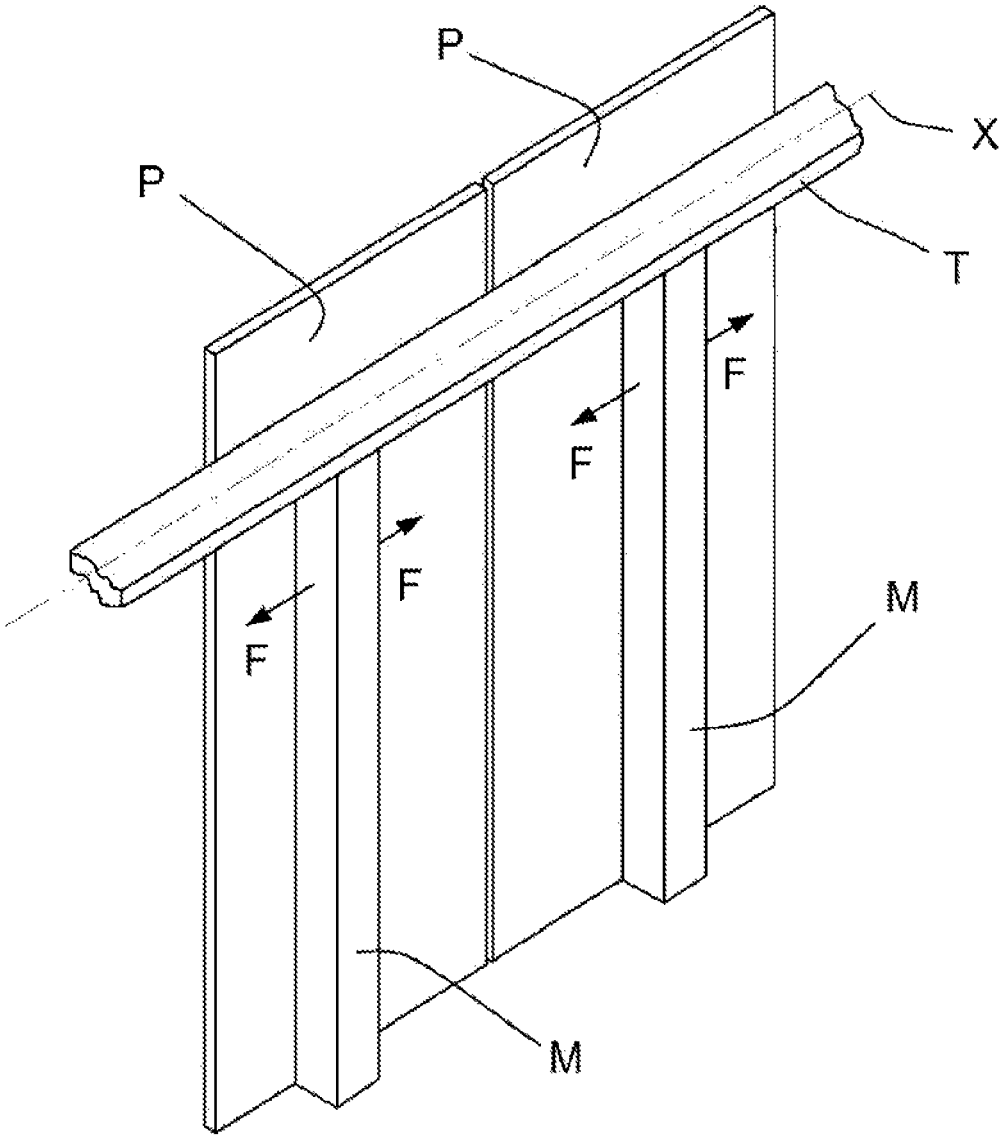
FIG. 1 PRIOR ART
FIG. 1 is a diagrammatic perspective view of a portion of a building structure according to the prior art.

With reference to the figures, a connection device according to the present invention is disclosed, which is generally indicated with reference numeral (1).

Figure 2:
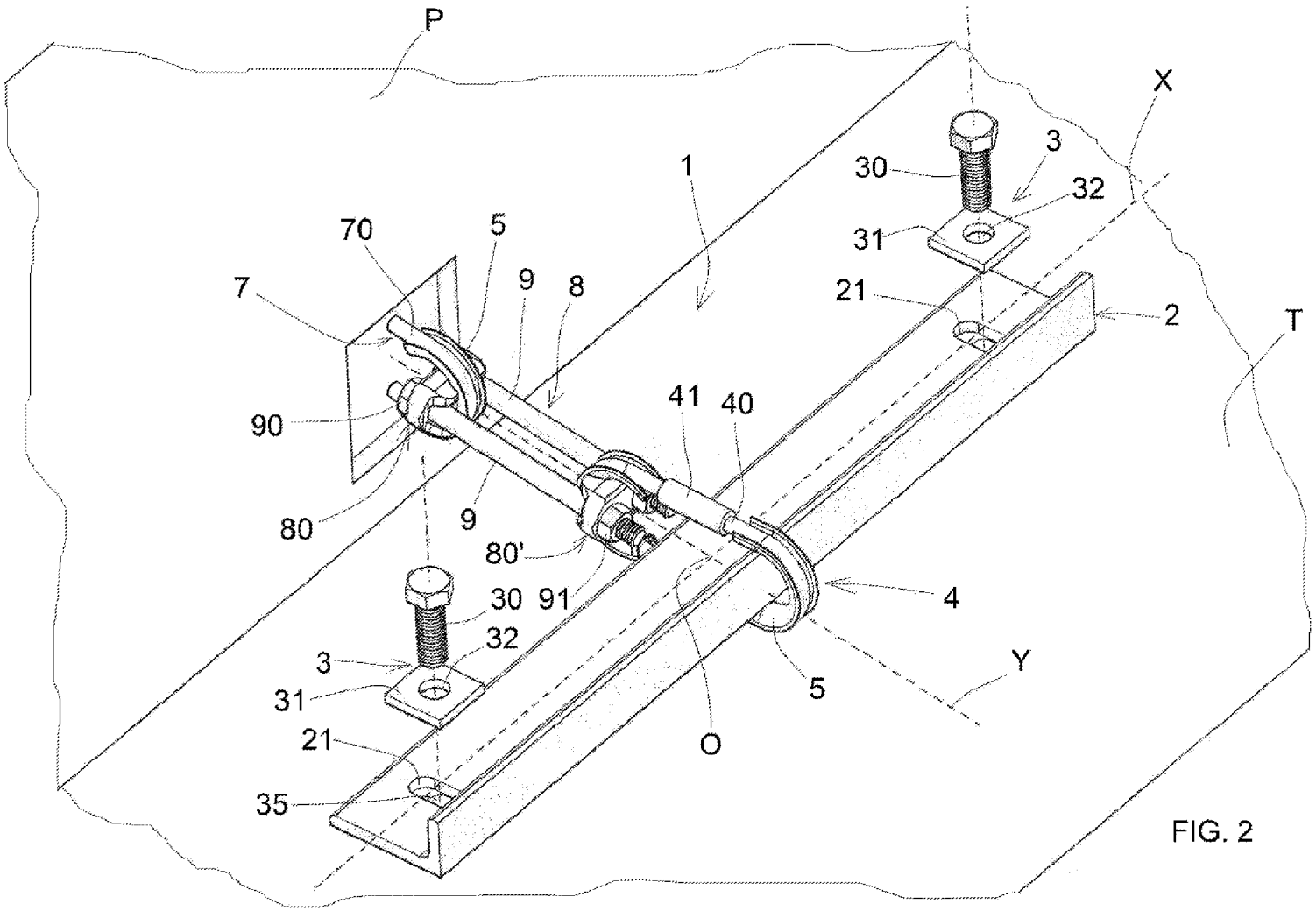
FIG. 2 is a perspective view of the connection device according to the present invention.

FIG. 2 shows a beam (T) and a panel (P) adapted to be connected to the beam (T) by means of the connection device (1). In the following description the terms "transverse" and "longitudinal" respectively refer to the transverse and longitudinal direction of the beam (T).

When the panel (P) is connected to the beam, the internal surface of the panel stops against a longitudinal edge of the beam and the upper surface of the beam is orthogonal to the internal surface of the panel.

The connection device (1) comprises a dissipating element (2) composed of a deformable bar shaped as a section and having a longitudinal axis (X). The dissipating element (2) is fixed to the beam (T) in such manner that the longitudinal axis (X) of the dissipating element is parallel to the longitudinal axis of the beam.

For illustration purposes, the dissipating element (2) has an L-shape in cross section and consists in a metal section, for example a steel section.

Figure 3:
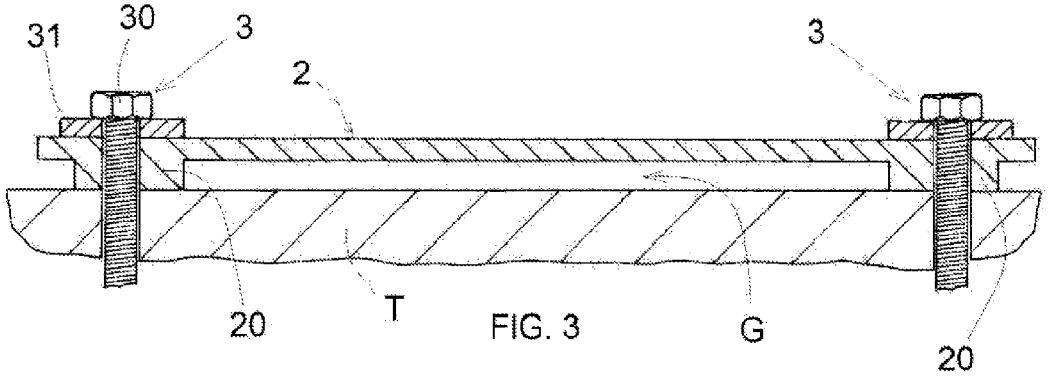
FIG. 3 is an axial sectional view of a dissipating element of the connection device of FIG. 2 fixed to a beam.

With reference to FIG. 3, the dissipating element (2) comprises two projections (20) disposed at the ends of the dissipating element, which are adapted to stop against the upper surface of the beam (T) in such manner to define a longitudinal space (G) between the dissipating element (2) and the beam (T).

The dissipating element (2) is fixed to the beam (T) by means of fixing means (3), such as for instance bolts (30) that pass through the slots (21) of the dissipating element and are engaged in holes (35) of the beam (T). A plate (31) with a hole (32) is disposed between the head of the bolt and the dissipating element.

The slots (21) are obtained in the projections (20) of the dissipating element and have a higher axis that extends in the transverse direction of the dissipating element, to adjust the position of the dissipating element and allow for a limited relative displacement between the dissipating element and the beam in the transverse direction of the beam.

Obviously, the bolts (30) can be replaced by equivalent fixing means, such as soldering, riveting, pressure-coupling and similar means in order to fix the dissipating element to the beam.

A sliding connector (4) is slidingly connected to the dissipating element (2) in such manner to slide along the longitudinal axis (X) of the dissipating element.

The sliding connector (4) comprises a rope or cable (40) closed as a loop around the dissipating element (2). Preferably, the cable (40) is composed of twisted steel wires. The cable (40) can be replaced by a simple ring, preferably made of steel, such as the rings used in the harness of ropes for crane lifting.

A closure (41) connects the two ends of the cable (40) in order to form a ring. In this way, the connector can slide along the longitudinal space (G) between the dissipating element and the beam. The projections (20) of the dissipating element act as stops for the sliding connector (4).

In order to favor the sliding movement of the sliding connector on the dissipating element, a cable gland (5) is disposed between the dissipating element (2) and the cable (40).

Figure 4:
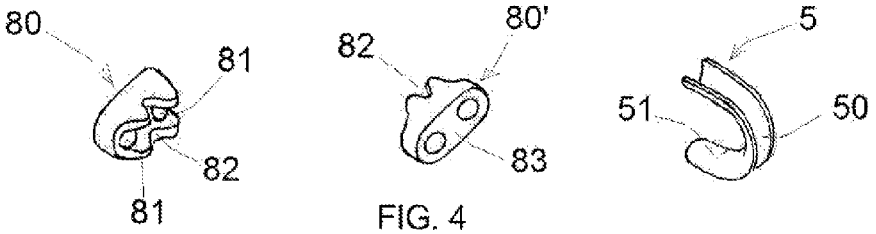
FIG. 4 is an exploded perspective view of two parts of a tensioning element and one cable gland of FIG. 2.

With reference to FIG. 4, the cable gland (5) has a basically C-shaped arched shape provided with an external channel (50) adapted to receive the cable (40) and an internal rounded surface (51) adapted to slide on the dissipating element.

Figure 5:
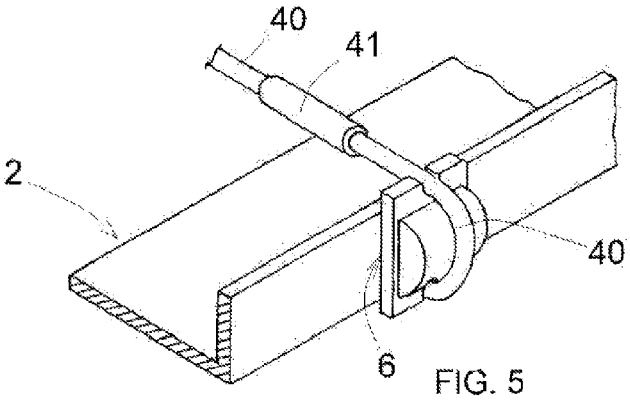
FIG. 5 is a partially interrupted perspective view that shows an improvement of the connection device of FIG. 2.
Figure 6:
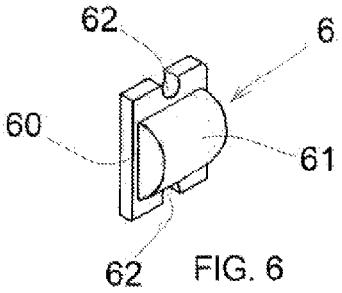
FIG. 6 is a perspective view of a sliding insert of the improvement of FIG. 5.

Referring to FIGS. 5 and 6, according to an improvement of the present invention, the cable gland (5) is replaced by a sliding insert (6) disposed between the cable (40) and the dissipating device (2). The insert (6) comprises a plate (60) made of a material with a low friction coefficient, such as for example teflon, which slides on the dissipating element and a semi-cylindrical support (61) acting as cable gland. The teflon plate (60) has two grooves (62) wherein the cable (40) is fitted. In view of the above, because of the friction between the plate (60), the cable (40), the support (61) and the dissipating element (2), no fixing is necessary between the teflon plate (60) and the support (61).

In such a case, the dissipating element preferably has an L-shape in cross section and is provided with a portion orthogonal to the surface of the beam (T) whereon the teflon plate (60) of the insert (6) slides.

Going back to FIG. 2, the connection device (1) comprises a fixed connector (7) fixed to the panel (P) in correspondence of a transverse axis (Y) orthogonal to the longitudinal axis (X) of the dissipating element and passing through a mid point (O) of the dissipating element (2). The transverse axis (Y) is orthogonal to the panel (P) and parallel to the upper surface of the beam (T).

The fixed connector (7) can be a U-bent cable (70) with ends fixed to the panel (P) in such manner that the transverse axis (Y) passes through the mid point between the ends of the cable (70). The fixed connector (7) can also be an eyebolt.

Between the fixed connector (7) and the sliding connector (4) a tensioning element (8) is provided, with tensioning axis that coincides with the transverse axis (Y). The tensioning element (8) can be manually activated by the user in order to bring the panel (P) closer to the beam until the panel (P) stops against the longitudinal edge of the beam (T).

The tensioning element (8) comprises a first clamp (80) and a second clamp (80') respectively connected to the fixed connector (7) and the sliding connector (4).

With reference to FIG. 4, each clamp (80, 80') comprises:

- two through holes (81),
- an arched central seat (82) disposed between the through holes (81), and
- a flat surface (83) opposite to the arched seat (82).

Cable glands (5) are disposed between the cables (70, 40) of the fixed connector and of the sliding connector and the corresponding clamps (80, 80'). The internal surface (51) of the cable glands (5) is engaged in the central seat (82) of the clamps. Instead, the external channel (51) of the cable glands respectively receives the cable (70) of the fixed connector and the cable (40) of the sliding connector.

Two bolts (9) are respectively engaged in the holes (81) of the two connectors. The bolts (9) have a head (90) that is stopped against the flat surface (83) of the clamp connected to the fixed connector. Nuts (91) are screwed onto the bolts and stopped against the flat surface (83) of the clamp connected to the sliding connector. The axes of the bolts (9) are parallel to the transverse axis (Y) disposed in intermediate position between the two bolts (9).

By screwing the bolts in the nuts (91), the two clamps (80, 80') are brought closer one to each other and the panel (P) is brought closer to the beam (T) in the direction of the axis (Y), until the panel (P) stops against the longitudinal edge of the beam. In this way the panel (P) is connected to the beam (T).

Although the figures show a linear tensioning element that comprises two clamps (80, 80') and two bolts (9) in parallel direction, it is evident that an equivalent linear tensioning element with a different shape can be used, as long as it is able to obtain tensioning along the transverse axis (Y).

It must be noted that the connection device (1) does not allow for a relative displacement of the panel (P) with respect to the beam (T) in the direction of the transverse axis (Y). Instead, the connection device (1) allows for a relative movement of the panel (P) with respect to the beam (T) in the direction of the longitudinal axis (X) because the sliding connector (4) can slide with respect to the dissipating device (2) along the longitudinal axis (X).

Consequently, if the beam (T) suffers oscillations in the direction of the longitudinal axis (X) during an earthquake, the dissipating element (2) fixed to the beam (T) can slide with respect to the sliding connector (4) in the direction of the axis (X) independently from the panel (P), thus avoiding shearing stress on the panel (P) and consequently preventing the panel (P) from breaking. Moreover, advantageously, the dissipating element (2) is made of a deformable material and is connected to the beam (T) only at its longitudinal ends, in such manner to get deformed without breaking during the oscillations of the beam (T) and keep the panel (P) always fixed to the beam (T) in the direction of the transverse axis (Y).

It must be additionally noted that the dissipating element (2) is not embedded in the beam (T) and protrudes externally from the beam in such manner to deform freely and dissipate the load.

Although a specific reference to a beam (T) and a panel (P) is made in the figures, the device (1) of the invention can be likewise used for any type of structural coupling similar to the coupling between panel and beam and in particular every time the design requires a dissipating constraint in one direction and a sliding constraint in the direction orthogonal to the dissipating fixing.

Variations and modifications can be made to the present embodiments of the invention, within the reach of an expert of the field, while still falling within the scope of the invention.

The invention claimed is:

1. A seismic connection apparatus comprising:

a panel;

a beam having a longitudinal axis;

a bar-shaped dissipating element having a longitudinal axis fixed to said beam such that said longitudinal axis of said dissipating element is parallel to said longitudinal axis of said beam;

a sliding connector slidingly mounted on said dissipating element so as to slide along said longitudinal axis of said dissipating element;

a fixed connector fixed to said panel in correspondence to said longitudinal axis of said dissipating element and passing through a midpoint of said dissipating element; and a tensioning element disposed between said fixed connector and said sliding connector so as to allow for a linear displacement of said fixed connector toward said sliding connector in a transverse direction until said panel stops against a longitudinal edge of said beam so as to connect said panel to said beam, wherein said panel is not able to move with respect to said beam in the transverse direction and wherein said panel is able to move with respect to said beam in a direction of said longitudinal axis of said dissipating element, said sliding connector comprising a cable or rope closed as a ring around said dissipating element.

2. The seismic connection apparatus of claim 1, said dissipating element has a deformable section.

3. The seismic connection apparatus of claim 1, said dissipating element having a pair of projections at ends thereof, the pair of projections adapted to stop against said beam so as to define a longitudinal space in which said sliding connector slides.

4. The seismic connection apparatus of claim 1, further comprising:

a bolt fixing said dissipating element to said beam.

5. The seismic connection apparatus of claim 1, said sliding element connector comprising a cable gland having an arched C-shape, said cable gland having an external seat adapted to receive said cable or rope of said sliding connector.

6. The seismic connection apparatus of claim 1, said sliding connector comprising an insert disposed between said cable or rope and said dissipating element, said insert having a low-friction coefficient plate adapted to slide on said dissipating element and a semi-cylindrical support acting as a cable gland.

7. A seismic connection apparatus comprising:

a panel;

a beam having a longitudinal axis;

a bar-shaped dissipating element having a longitudinal axis fixed to said beam such that said longitudinal axis of said dissipating element is parallel to said longitudinal axis of said beam;

a sliding connector slidingly mounted on said dissipating element so as to slide along said longitudinal axis of said dissipating element;

a fixed connector fixed to said panel in correspondence to said longitudinal axis of said dissipating element and passing through a midpoint of said dissipating element; and a tensioning element disposed between said fixed connector and said sliding connector so as to allow for a linear displacement of said fixed connector toward said sliding connector in a transverse direction until said panel stops against a longitudinal edge of said beam so as to connect said panel to said beam, wherein said panel is not able to move with respect to said beam in the transverse direction and wherein said panel is able to move with respect to said beam in a direction of said longitudinal axis of said dissipating element, said fixed connector comprising eyelet or a cable or a rope been in a U-shape and having ends affixed to said panel.

8. A seismic connection apparatus comprising:

a panel;

a beam having a longitudinal axis;

a bar-shaped dissipating element having a longitudinal axis fixed to said beam such that said longitudinal axis of said dissipating element is parallel to said longitudinal axis of said beam;

a sliding connector slidingly mounted on said dissipating element so as to slide along said longitudinal axis of said dissipating element;

a fixed connector fixed to said panel in correspondence to said longitudinal axis of said dissipating element and passing through a midpoint of said dissipating element; and a tensioning element disposed between said fixed connector and said sliding connector so as to allow for a linear displacement of said fixed connector toward said sliding connector in a transverse direction until said panel stops against a longitudinal edge of said beam so as to connect said panel to said beam, wherein said panel is not able to move with respect to said beam in the transverse direction and wherein said panel is able to move with respect to said beam in a direction of said longitudinal axis of said dissipating element, wherein said tensioning element comprises a first clamp and a second clamp respectively connected to said fixed connector and said sliding connector and a pair of bolts connected to said first clamp and said second clamp, said pair of bolts having parallel axes to the transverse direction such that said first and second clamps are brought together when screwing said pair of bolts.

9. The seismic connection apparatus of claim 8, further comprising:

a pair of cable glands respectively disposed between said first clamp and a cable of said fixed connector and between said second clamp and a cable of said sliding connector.

* * * * *